US009163551B2

(12) United States Patent
Nakatani et al.

(10) Patent No.: US 9,163,551 B2
(45) Date of Patent: Oct. 20, 2015

(54) COOLING SYSTEM FOR INTERNAL COMBUSTION ENGINE

(75) Inventors: Koichiro Nakatani, Mishima (JP); Akira Yamashita, Suntou-gun (JP); Takenori Saoda, Numazu (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 13/978,608

(22) PCT Filed: Feb. 7, 2011

(86) PCT No.: PCT/JP2011/052534

§ 371 (c)(1),
(2), (4) Date: Jul. 8, 2013

(87) PCT Pub. No.: WO2012/107990

PCT Pub. Date: Aug. 16, 2012

(65) Prior Publication Data

US 2013/0298850 A1 Nov. 14, 2013

(51) Int. Cl.
*F01P 3/00* (2006.01)
*F01P 7/16* (2006.01)

(52) U.S. Cl.
CPC . *F01P 3/00* (2013.01); *F01P 7/167* (2013.01); *F01P 2025/30* (2013.01); *F01P 2025/32* (2013.01)

(58) Field of Classification Search
CPC ..... F01P 3/20; F01P 11/14; F01P 11/16; F28D 20/00
USPC ..... 123/41.01, 41.02, 41.05, 41.08, 41.11, 123/41.12, 41.29
See application file for complete search history.

(56) References Cited

U.S. PATENT DOCUMENTS

| | | | | |
|---|---|---|---|---|
| 4,603,675 | A | 8/1986 | Junginger et al. | |
| 6,321,696 | B1 * | 11/2001 | Nishioka et al. | 123/41.15 |
| 6,804,588 | B2 * | 10/2004 | Oki et al. | 701/33.6 |
| 8,731,861 | B2 * | 5/2014 | Goya | 702/104 |
| 2002/0099482 | A1 * | 7/2002 | Reese et al. | 701/29 |
| 2006/0112701 | A1 * | 6/2006 | Dykstra | 62/132 |
| 2010/0031646 | A1 * | 2/2010 | Iwase et al. | 60/320 |

FOREIGN PATENT DOCUMENTS

| | | | | |
|---|---|---|---|---|
| JP | 54054355 | A * | 4/1979 | F25B 43/04 |
| JP | A-63-48791 | | 3/1988 | |
| JP | A-2-144693 | | 6/1990 | |
| JP | A-5-33712 | | 2/1993 | |
| JP | 2002201995 | A * | 7/2002 | F02D 45/00 |
| JP | A-2003-138940 | | 5/2003 | |
| JP | B-4385492 | | 12/2009 | |
| JP | A-2010-168538 | | 8/2010 | |

* cited by examiner

*Primary Examiner* — Marguerite McMahon
*Assistant Examiner* — Tea Holbrook
(74) *Attorney, Agent, or Firm* — Oliff PLC

(57) ABSTRACT

The character or nature of cooling water is correctly estimated. A cooling system for an internal combustion engine includes a radiator, a bypass passage which bypasses the radiator, a thermostat, and a control unit which changes a valve opening temperature of the thermostat. The cooling system for the internal combustion engine further includes an estimating unit which forbids valve opening of the thermostat and which estimates the character of the cooling water on the basis of temperature transition of the cooling water provided in this state.

6 Claims, 5 Drawing Sheets

COOLING SYSTEM FOR INTERNAL COMBUSTION ENGINE

TECHNICAL FIELD

The present invention relates to a cooling system for an internal combustion engine.

BACKGROUND ART

Cooling water, in which the specific heat is changed at a predetermined temperature, is known (see, for example, Patent Document 1). The cooling water is constructed such that capsules, in which a substance to cause the phase transition is enclosed, are dispersed in the liquid. On the other hand, a technique is known, in which the cooling water temperature is raised by forbidding the valve opening of a thermostat (see, for example, Patent Document 2).

In this context, the control of an electronic thermostat, which is performed in the same manner as in the conventional technique when the cooling water, in which the specific heat is changed at a predetermined temperature, is used in a system for controlling the electronic thermostat so that a preset cooling water temperature is provided, does not affirm that the characteristic, in which the specific heat of the cooling water is changeable, is utilized sufficiently.

On the other hand, the cooling water is exchanged by a user in some cases. Therefore, the cooling water is sometimes exchanged from cooling water in which the specific heat is changeable (i.e., cooling water that contains a substance to cause the phase transition) to cooling water in which the specific heat is not changed (i.e., cooling water that does not contain a substance to cause the phase transition). Further, the cooling water is sometimes exchanged to cooling water in which the specific heat is changed at any different temperature. The proper valve opening timing of the thermostat differs among these types of cooling water respectively. Therefore, unless the thermostat is controlled depending on the character or nature of the cooling water, it is feared that the overheat of the internal combustion engine may be caused, or a long period of time may be required until the warming-up of the internal combustion engine is completed.

PRECEDING TECHNICAL DOCUMENT

Patent Document

Patent Document 1: JP2010-168538A;
Patent Document 2: JP2003-138940A.

SUMMARY OF THE INVENTION

Task to be Solved by the Invention

The present invention has been made taking the foregoing problem into consideration, an object of which is to correctly estimate the character or nature of cooling water.

Solution for the Task

In order to achieve the object as described above, according to the present invention, there is provided a cooling system for an internal combustion engine comprising:

a radiator which is provided for a cooling water passage of the internal combustion engine and which deprives heat from cooling water;

a bypass passage which bypasses the radiator;

a thermostat which shuts off flow of the cooling water to the radiator so that the cooling water is allowed to flow to the bypass passage in a valve closed state and which allows the cooling water to flow through at least the radiator in a valve open state; and a control unit which changes a valve opening temperature of the thermostat, the cooling system for the internal combustion engine further comprising:

an estimating unit which forbids valve opening of the thermostat and which estimates a character of the cooling water on the basis of transition of a temperature of the cooling water provided thereby.

The estimation of the character or nature of the cooling water includes the estimation of whether or not the specific heat of the cooling water is changed at a predetermined temperature, and the estimation of the predetermined temperature. The predetermined temperature may be, for example, a temperature at which the structural phase transition occurs in the substance contained in the cooling water. That is, the heat is released or the heat is absorbed in accordance with the structural phase transition. Therefore, the specific heat of the cooling water is increased at the temperature at which the structural phase transition occurs. Therefore, the temperature of the cooling water is substantially constant at the predetermined temperature even when the heat is released or absorbed to some extent.

When the valve opening of the thermostat is forbidden or prohibited in this state, the cooling water does not flow through the radiator. Therefore, the temperature of the cooling water is gradually raised. The temperature transition or change, which is provided in this situation, is changed depending on the character or nature of the cooling water. Therefore, it is possible to estimate the character of the cooling water on the basis of the transition of temperature. Even when the valve opening of the thermostat is forbidden, if it is feared that the overheat may be caused, then it is also possible to permit the valve opening of the thermostat. That is, the temperature, at which the thermostat is subjected to the valve opening, may be set to an upper limit value of the temperature at which the overheat is not caused or the temperature at which the overheat can be suppressed. Further, when the character of the cooling water is estimated by the estimating unit, it is also allowable to raise the temperature at which the thermostat is subjected to the valve opening, as compared with when the character of the cooling water is not estimated.

In the present invention, the estimating unit can estimate whether cooling water having changeable specific heat is used or cooling water having specific heat that does not change is used. In this context, when the cooling water having the changeable specific heat is used, a term or period, in which the temperature of the cooling water is constant, is provided even in the case of such an operation state that the temperature of the cooling water may be raised. On the other hand, when the cooling water having the specific heat that does not change is used, such a term is not provided. Therefore, it is possible to estimate whether the cooling water having the changeable specific heat is used or the cooling water having the specific heat that does not change is used, on the basis of the transition of the temperature of the cooling water.

In the present invention, the estimating unit can estimate a temperature at which the specific heat is changed when the cooling water having the changeable specific heat is used. In this context, when the cooling water having the changeable specific heat is used, a term or period is provided, in which the temperature is constant upon the arrival at the temperature of change of the specific heat. Therefore, it is possible to estimate the temperature at which the specific heat is changed, on the basis of the transition of the temperature of the cooling water.

In the present invention, the estimating unit can estimate, when the valve opening of the thermostat is forbidden, that:

cooling water having changeable specific heat is used, and a temperature, at which the temperature of the cooling water is constant, is the temperature of change of the specific heat of the cooling water if the temperature of the cooling water becomes constant; or cooling water having specific heat that does not change is used if the temperature of the cooling water does not become constant.

In this context, when the cooling water having the changeable specific heat is used, a term or period, in which the temperature of the cooling water is constant, is provided even in the case of such an operation state that the temperature of the cooling water may be raised. If the temperature of the cooling water becomes constant as described above, it can be judged that the cooling water having the changeable specific heat is used. On the other hand, if the temperature of the cooling water does not become constant, it can be judged that the cooling water having the specific heat that does not change is used. Further, the temperature of the cooling water is constant when the specific heat is changed. Therefore, it can be judged that the temperature, at which the temperature of the cooling water is constant, is the temperature at which the specific heat is changed.

In the present invention, the valve opening temperature of the thermostat, which is provided when the cooling water having the changeable specific heat is used, can be set by the control unit to be higher than the temperature at which the specific heat is to be changed as estimated by the estimating unit.

In this context, when the thermostat is opened, then the cooling water is allowed to flow through the radiator, and hence the temperature increase of the cooling water is suppressed. If the thermostat is opened at a temperature which is lower than the temperature of change of the specific heat of the cooling water, then the temperature increase to arrive at the temperature of change of the specific heat of the cooling water is suppressed, and hence it is impossible to utilize such a characteristic that the specific heat is to be increased. On the other hand, if the setting is made such that the thermostat is opened at a temperature which is higher than the temperature of change of the specific heat of the cooling water, then the specific heat of the cooling water may be increased when the thermostat is closed, and hence it is possible to utilize such a characteristic that the specific heat is to be increased. That is, the temperature of the cooling water can be maintained constantly when the thermostat is closed. Therefore, it is unnecessary to perform any control corresponding to the fluctuation of the temperature of the cooling water. Therefore, it is possible to stabilize the operation state of the internal combustion engine.

In the present invention, the estimating unit can estimate whether or not the cooling water is deteriorated on the basis of a difference between a temperature of the cooling water at a position at which the temperature is higher than the temperature of change of the specific heat and a temperature of the cooling water at a position at which the temperature is lower than the temperature of change of the specific heat.

In this context, when the cooling water passes through the internal combustion engine, then the heat is moved from the internal combustion engine to the cooling water, and hence the temperature of the cooling water is raised. On the other hand, when the cooling water passes through the radiator, then the heat is deprived from the cooling water, and hence the temperature of the cooling water is lowered. In this way, the temperature of the cooling water may be changed between the upstream and the downstream of the internal combustion engine and between the upstream and the downstream of the radiator. When the cooling water having the changeable specific heat is used, it is possible to suppress the fluctuation of the temperature of the cooling water on condition that the temperature, at which the specific heat is changed, is previously set so that the specific heat is changed when the cooling water passes through the internal combustion engine or when the cooling water passes through the radiator. That is, the position, at which the temperature is higher than the temperature of change of the specific heat, includes the cooling water passage which is disposed downstream from the internal combustion engine and upstream from the radiator. Further, the position, at which the temperature is lower than the temperature of change of the specific heat, includes the cooling water passage which is disposed downstream from the radiator and upstream from the internal combustion engine. However, if the cooling water is deteriorated, then the change of the specific heat is insufficient in some cases, and/or the specific heat is not changed in other cases. Therefore, the fluctuation of the temperature of the cooling water is increased. That is, the difference, which is provided between the temperature of the cooling water at the position at which the temperature is higher than the temperature of change of the specific heat and the temperature of the cooling water at the position at which the temperature is lower than the temperature of change of the specific heat, is increased depending on the degree of the deterioration of the cooling water. Therefore, it is possible to estimate the deterioration of the cooling water on the basis of the temperature difference.

In the present invention, the estimating unit can estimate that the cooling water is deteriorated, if the difference between the temperature of the cooling water at the position at which the temperature is higher than the temperature of change of the specific heat and the temperature of the cooling water at the position at which the temperature is lower than the temperature of change of the specific heat is larger than a threshold value. The threshold value referred to herein can be the difference between the temperatures at the boundary of whether or not the cooling water is deteriorated. That is, the larger the degree of deterioration is, the larger the temperature difference is. Therefore, when the threshold value is set beforehand, it is possible to easily estimate the deterioration of the cooling water by comparing the temperature difference with the threshold value. It is also possible to estimate that the larger the temperature difference is, the larger the degree of deterioration of the cooling water is.

In the present invention, the estimating unit can periodically estimate the character of the cooling water. In this context, the cooling water is deteriorated as the time elapses, and the character or nature thereof is changed in some cases. On the other hand, the character or nature of the cooling water is also changed in some cases when a user exchanges the cooling water. Therefore, when the character of the cooling water is estimated periodically, even if the character of the cooling water is changed, then it is possible to optimize the opening/closing condition of the thermostat. The term "periodically" may include every time when a predetermined travel distance is provided and every time when a predetermined period of time elapses.

Effect of the Invention

According to the present invention, it is possible to correctly estimate the character or nature of the cooling water.

Accordingly, it is possible to properly set the valve opening temperature of the thermostat.

MODE FOR CARRYING OUT THE INVENTION

Specified embodiments of the cooling system for the internal combustion engine according to the present invention will be explained below on the basis of the drawings.

First Embodiment

Figure 1:
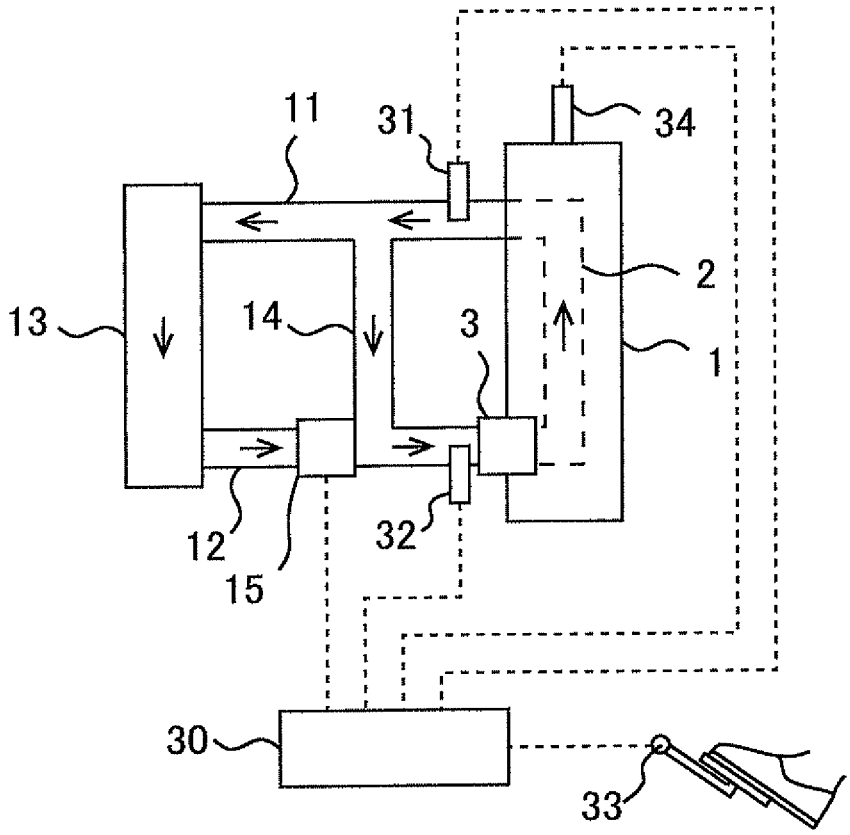
FIG. 1 shows a schematic arrangement of a cooling system for an internal combustion engine according to an embodiment.

FIG. 1 shows a schematic arrangement of a cooling system for an internal combustion engine according to this embodiment. The internal combustion engine 1 shown in FIG. 1 is a water cooling type internal combustion engine.

A water jacket 2, which is provided to circulate the cooling water, is formed in the internal combustion engine 1. A first cooling water passage 11 and a second cooling water passage 12 are connected to the internal combustion engine 1. A radiator 13 and a bypass passage 14 are connected to the first cooling water passage 11 and the second cooling water passage 12.

The first cooling water passage 11 connects the outlet side of the water jacket 2 and the inlet side of the radiator 13. That is, the first cooling water passage 11 is the passage which is provided to discharge the cooling water from the water jacket 2. On the other hand, the second cooling water passage 12 connects the outlet side of the radiator 13 and the inlet side of the water jacket 2. That is, the second cooling water passage 12 is the passage which is provided to supply the cooling water to the water jacket 2.

A water pump 3, which discharges the cooling water from the side of the second cooling water passage 12 to the side of the water jacket 2, is provided at the connecting portion between the second cooling water passage 12 and the water jacket 2.

The bypass passage 14 bypasses the radiator 13 by making communication between the first cooling water passage 11 and the second cooling water passage 12.

An electronic control type thermostat 15 is provided at a portion of the second cooling water passage 12 disposed on the side of the radiator 13 as compared with the connecting portion between the second cooling water passage 12 and the bypass passage 14. The opening degree of the thermostat 15 is adjusted in accordance with the signal supplied from ECU 30 as described later on. The amount of the cooling water supplied to the radiator 13 is adjusted by controlling the opening degree of the thermostat 15.

When the thermostat 15 is closed, the cooling water, which is allowed to outflow from the water jacket 2 to the first cooling water passage 11, is fed to the water jacket 2 again via the bypass passage 14. The cooling water is gradually warmed in accordance with the circulation of the cooling water as described above, and the warming-up of the internal combustion engine 1 is facilitated.

On the other hand, when the thermostat 15 is open, the cooling water is circulated via the radiator 13 and the bypass passage 14. The cooling water is also circulated to portions other than the radiator 13 and the bypass passage 14 irrelevant to the state of the thermostat 15. However, these portions are omitted from FIG. 1.

An outlet side temperature sensor 31, which measures the temperature of the cooling water allowed to outflow from the water jacket 2 (hereinafter referred to as "outlet side temperature" as well), is attached to the first cooling water passage 11 disposed between the connecting portion of the water jacket 2 and the connecting portion of the bypass passage 14. Further, an inlet side temperature sensor 32, which measures the temperature of the cooling water allowed to inflow into the water jacket 2 (hereinafter referred to as "inlet side temperature" as well), is attached to the second cooling water passage 12 disposed between the connecting portion of the water jacket 2 and the connecting portion of the bypass passage 14.

ECU 30, which is the electronic control unit to control the internal combustion engine 1, is provided in combination with the internal combustion engine 1 constructed as described above. ECU 30 controls the internal combustion engine 1 in accordance with the operation condition of the internal combustion engine 1 and the request of a driver.

Further, an accelerator opening degree sensor 33 which outputs the electric signal corresponding to the accelerator opening degree to detect the engine load and a crank position sensor 34 which detects the number of revolutions of the engine are connected to ECU 30 via the electric wiring lines other than the sensor described above. The output signals of the sensors are inputted into ECU 30. On the other hand, the thermostat 15 is connected to ECU 30 via the electric wiring line. ECU 30 controls the thermostat 15. In this embodiment, ECU 30, which controls the thermostat 15, corresponds to the control unit according to the present invention.

In this arrangement, the cooling water, in which the specific heat is changeable at a predetermined temperature, can be used as the cooling water according to this embodiment. The cooling water is constructed to include, for example, the substance which causes the phase transition from the solid to the liquid or from the liquid to the solid at the predetermined temperature. That is, when the temperature arrives at the predetermined temperature during the process in which the temperature of the cooling water is raised, then the substance, which is contained in the cooling water, is changed from the solid to the liquid, and the heat is absorbed from the surroundings in this situation. On the other hand, when the temperature arrives at the predetermined temperature during the process in which the temperature of the cooling water is lowered, then the substance, which is contained in the cooling water, is changed from the liquid to the solid, and the heat is released to the surroundings in this situation. When the phase transition is caused between the liquid and the solid as described above, the specific heat of the cooling water is changed.

Figure 2:
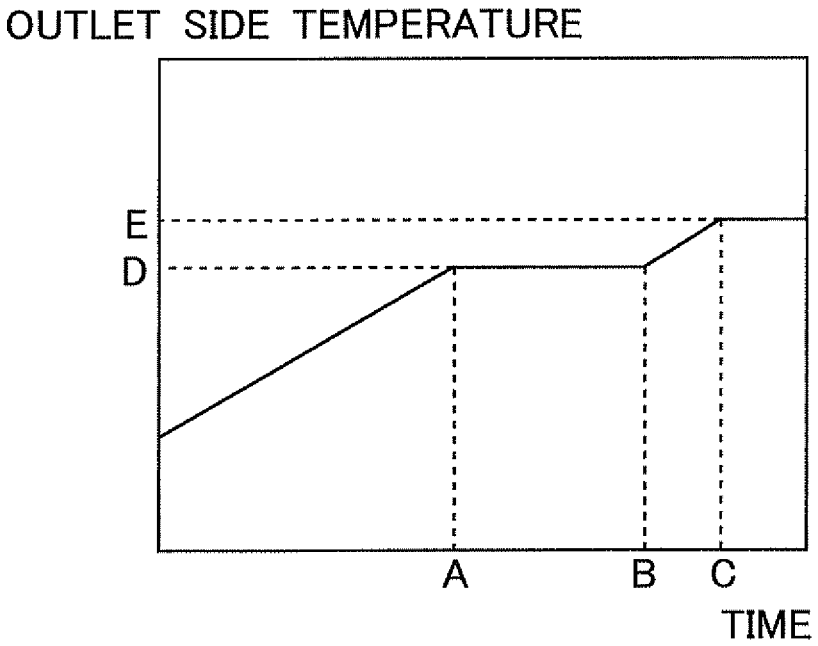
FIG. 2 shows a time chart illustrating the transition of the outlet side temperature during the warming-up of the internal combustion engine.

FIG. 2 shows a time chart illustrating the transition of the outlet side temperature during the warming-up of the internal combustion engine 1. With reference to FIG. 2, the outlet side temperature is constant at the predetermined temperature D during a period of time from A to B. The temperature E, at which the thermostat 15 is opened, is provided at a time indicated by C, and the thermostat 15 is open. Accordingly, the cooling water is allowed to flow through the radiator 13, and hence the outlet side temperature is substantially constant. The outlet side temperature and the inlet side temperature are substantially identical with each other until the thermostat 15 is opened.

That is, the phase transition is caused at the predetermined temperature D, and hence the specific heat of the cooling water is raised as compared with the other temperatures. Therefore, as shown in FIG. 2, the outlet side temperature is constant at the predetermined temperature D during the period of time from A to B. FIG. 2 shows such a case that the temperature E, at which the thermostat 15 is opened, is higher than the predetermined temperature D. The predetermined temperature D, which is the temperature of change of the specific heat, is hereinafter referred to as "temperature of specific heat change D" as well.

As described above, when the setting is made beforehand such that the thermostat 15 is opened when the outlet side temperature is higher than the temperature of specific heat change D, it is possible to utilize such a characteristic that the specific heat of the cooling water is raised, i.e., such a characteristic that the cooling water temperature becomes constant. That is, when the cooling water temperature is raised, the temperature increase can be suppressed by depriving the heat. When the cooling water temperature is lowered, the temperature decrease can be suppressed by giving the heat. Therefore, it is possible to suppress the fluctuation of the cooling water temperature, and hence it is possible to stabilize the operation state of the internal combustion engine 1.

The temperature E, at which the thermostat 15 is opened, may be, for example, a temperature at which the warming-up of the internal combustion engine 1 is completed. However, there is no limitation thereto. Further, the component contained in the cooling water may be determined so that the temperature of specific heat change D is lower than the temperature at which the warming-up of the internal combustion engine 1 is completed. The optimum value of the temperature of specific heat change D can be determined, for example, by means of an experiment.

When the user exchanges the cooling water, it is conceived that the cooling water, in which the specific heat is changed at the temperature of specific heat change D, is exchanged with any cooling water in which the specific heat is not changed. It is also conceived that the temperature of specific heat change D before the exchange is different from that after the exchange. Further, even when the cooling water is not exchanged, the temperature of specific heat change D sometimes changes due to the deterioration of the cooling water. In such situations, it is possible to suppress the overheat of the internal combustion engine 1 and the deterioration of the mileage (fuel efficiency) by making the setting such that the temperature, at which the thermostat 15 is opened, is set to the values corresponding to the respective types of cooling water.

In view of the above, in this embodiment, it is judged whether or not the specific heat of the cooling water is changed. Further, if the specific heat of the cooling water is changed, the temperature of specific heat change D is determined.

Figure 3:
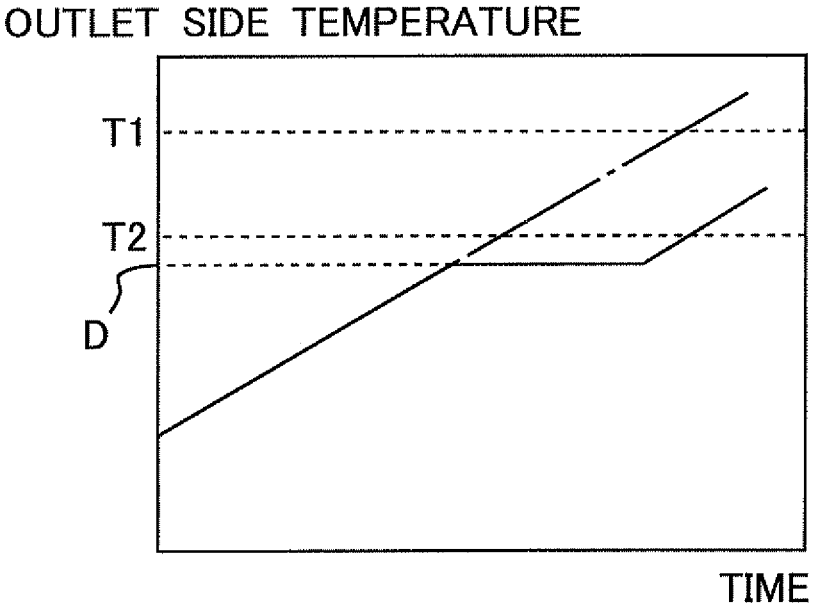
FIG. 3 shows a relationship among the temperature of specific heat change, the valve opening temperature of a thermostat set when the temperature of change of the specific heat is estimated, and the valve opening temperature of the thermostat set on the basis of the temperature of specific heat change.

FIG. 3 shows a relationship among the temperature of specific heat change D, the valve opening temperature T1 of the thermostat 15 set when the temperature of change of the specific heat is estimated, and the valve opening temperature T2 of the thermostat 15 set on the basis of the temperature of specific heat change D. A solid line indicates a case in which the specific heat of the cooling water is changed, and an alternate long and short dash line indicates a case in which the specific heat of the cooling water is not changed. The horizontal axis indicates the time.

The valve opening temperature T1 of the thermostat 15, which is set when the temperature of specific heat change D is estimated, is set to the temperature which is higher than the temperature estimated as the temperature of specific heat change D last time and which is lower than the temperature of overheat of the internal combustion engine 1. Further, the valve opening temperature T1 of the thermostat 15 is set to the temperature which is higher than the temperature at which the specific heat of the cooling water may be changed. The valve opening temperature T1 of the thermostat 15 is set in order to suppress the overheat of the internal combustion engine 1. Therefore, it is also affirmed that the valve opening of the thermostat 15 is forbidden or prohibited until arrival at the concerning temperature.

When the valve opening temperature T1 of the thermostat 15 is set as described above, if the cooling water, in which the specific heat is changeable, is used, then the specific heat is changed before arrival at the valve opening temperature T1 of the thermostat 15, and hence a term or period, in which the temperature is constant, is provided. That is, when the term, in which the temperature of the cooling water is constant, is provided, it is possible to judge that the cooling water, in which the specific heat is changeable, is used. The concerning temperature, which is provided in the term of the constant temperature, can be judged to be the temperature of specific heat change D. After that, a temperature, which is higher than the temperature D of change of the specific heat by a predetermined value, is set as the valve opening temperature T2 of the thermostat 15. The valve opening temperature T2 is the temperature at which the thermostat 15 is subjected to the valve opening in any situation other than the situation provided when it is estimated whether or not the cooling water having the changeable specific heat is used or when the temperature of specific heat change D is estimated.

On the other hand, if the term, in which the temperature of the cooling water is constant, is absent, it is possible to judge that the cooling water, in which the specific heat does not change, is used. In this case, the valve opening temperature T2 of the thermostat 15 is set to the temperature adopted when the cooling water having the specific heat that does not change is used. The valve opening temperature T2 is previously stored in ECU 30.

Figure 4:
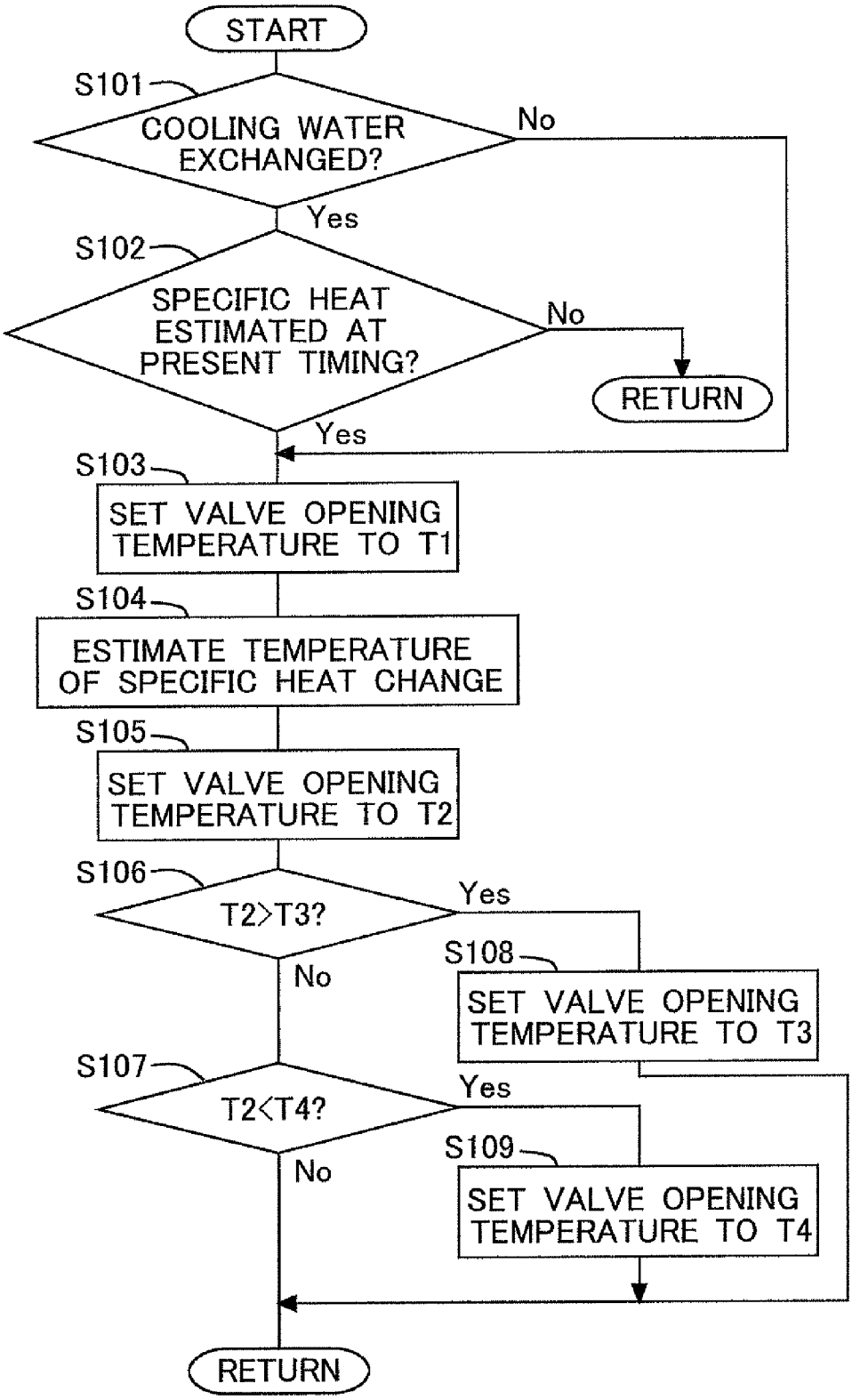
FIG. 4 shows a flow chart illustrating a flow of the temperature control of the cooling water according to the first embodiment.

FIG. 4 shows a flow chart illustrating a flow of the temperature control of the cooling water according to this embodiment. This routine is executed every time when a predetermined period of time elapses.

In Step S101, it is judged whether or not the cooling water is exchanged. That is, it is judged whether or not the specific heat of the cooling water may be possibly changed. For example, a sensor, which detects the water level of the cooling water, may be provided, and it is possible to judge that the cooling water is exchanged, when the water level of the cooling water, which is detected by the sensor, is lowered to a predetermined value. Alternatively, the judgment can be also made on the basis of the temperature detected by the outlet side temperature sensor 31 or the inlet side temperature sensor 32. Further alternatively, a switch, which is to be depressed by a user when the cooling water is exchanged, may be installed beforehand, and the judgment can be also made on the basis of whether or not the switch is depressed. If the affirmative judgment is made in Step S101, the routine proceeds to Step S103. If the negative judgment is made, the routine proceeds to Step S102.

In Step S102, it is judged whether or not the specific heat of the cooling water should be estimated at the present timing. For example, when the vehicle travels a preset distance, or when a preset period of time elapses, then it is judged that the specific heat of the cooling water should be estimated at the present timing. This timing is previously set, for example, as a timing at which the cooling water may be deteriorated. If the affirmative judgment is made in Step S102, the routine proceeds to Step S103. If the negative judgment is made, this routine is completed, because it is unnecessary to change the valve opening temperature T2 of the thermostat 15.

In Step S103, the valve opening temperature of the thermostat 15 is set to the valve opening temperature T1 of the thermostat 15 which is set when the temperature of the specific heat change D is estimated. That is, the valve opening temperature of the thermostat 15 is made higher than the valve opening temperature T2 of the thermostat 15 which is set when this routine is not executed. The valve opening temperature T1, which is provided in this situation, is set to be higher than the temperature at which the specific heat may be changed when the cooling water having the changeable specific heat is used and lower than the temperature at which the internal combustion engine 1 is overheated. In this step, it is also affirmed that the valve opening of the thermostat 15 is forbidden in order to judge the temperature of specific heat change D or in order to judge whether or not the cooling water having the changeable specific heat is used.

In Step S104, the temperature of specific heat change D is estimated on the basis of the transition of the cooling water temperature. That is, the term (timing), in which the cooling water temperature is constant, is detected, and the temperature, which is provided in the term of the constant cooling water temperature, is estimated as the temperature of specific heat change D. If the term (timing), in which the cooling water temperature is constant, is absent, it is estimated that the cooling water having the specific heat that does not change is used. The cooling water temperature is constant, for example, during the idle operation irrelevant to whether or not the specific heat of the cooling water is changeable. Therefore, in this step, the term (timing) is detected, in which the cooling water temperature is constant in spite of such an operation state that the cooling water temperature may be raised. Therefore, the temperature of specific heat change D is estimated while considering the operation state of the internal combustion engine 1. In this embodiment, ECU 30, which processes Step S103 and Step S104, corresponds to the estimating means according to the present invention.

In Step S105, the temperature, which is higher than the temperature of specific heat change D by a predetermined value, is set as the valve opening temperature T2 of the thermostat 15. Alternatively, the temperature, which is higher than the temperature of specific heat change D by a predetermined ratio, may be set as the valve opening temperature T2 of the thermostat 15. The valve opening temperature T2 of the thermostat 15, which is set in this situation, is the temperature at which the thermostat 15 is to be opened when this routine is not executed. If the temperature of specific heat change D is absent, the temperature, which is previously stored in ECU 30, is set as the valve opening temperature T2 of the thermostat 15.

In Step S106, it is judged whether or not the valve opening temperature T2 of the thermostat 15, which is set in Step S105, is higher than the upper limit value T3. The upper limit value T3 is set, for example, as the upper limit value of the temperature at which it is not feared that the internal combustion engine 1 may overheat. That is, if the valve opening temperature T2 of the thermostat 15 is increased due to the excessively high temperature of specific heat change D, it is feared that the internal combustion engine 1 may overheat. Therefore, the upper limit value T3 is set. If the affirmative judgment is made in Step S106, then the routine proceeds to Step S108, and the valve opening temperature T2 of the thermostat 15 is set to the upper limit value T3 again. If the negative judgment is made in Step S106, the routine proceeds to Step S107.

In Step S107, it is judged whether or not the valve opening temperature T2 of the thermostat 15, which is set in Step S105, is lower than the lower limit value T4. The lower limit value T4 is, for example, the lower limit value of the valve opening temperature of the thermostat 15 at which the mileage or fuel efficiency is within an allowable range. That is, if the valve opening temperature T2 of the thermostat 15 is lowered due to the excessively low temperature of specific heat change D, it is feared that the fuel efficiency of the internal combustion engine 1 may be deteriorated. Therefore, the lower limit value T4 is set. If the negative judgment is made in Step S107, then the valve opening temperature T2 of the thermostat 15, which is set in Step S105, is adopted as it is, and this routine is completed. On the other hand, if the affirmative judgment is made in Step S107, then the routine proceeds to Step S109, and the valve opening temperature T2 of the thermostat 15 is set to the lower limit value T4 again.

As explained above, according to this embodiment, it is possible to judge whether or not the cooling water having the changeable specific heat is used, by forbidding the valve opening of the thermostat 15 or setting the valve opening temperature to the high temperature. Further, when the cooling water having the changeable specific heat is used, it is possible to estimate the temperature at which the specific heat is changed. Further, the upper limit value T3 is set for the valve opening temperature of the thermostat 15, and thus it is possible to suppress the overheat of the internal combustion engine 1. Further, the lower limit value T4 is set for the valve opening temperature of the thermostat 15, and thus it is possible to suppress the deterioration of the fuel efficiency of the internal combustion engine 1. Thus, it is possible to properly set the valve opening temperature of the thermostat 15.

Second Embodiment

In this embodiment, it is judged whether or not the cooling water is deteriorated on the basis of the width of change of the cooling water temperature when ECU 30 controls the thermostat 15 in accordance with the valve opening temperature T2 of the thermostat 15 set in the first embodiment. For example, the other units or devices are the same as those of the first embodiment, any explanation of which will be omitted.

Figure 5:
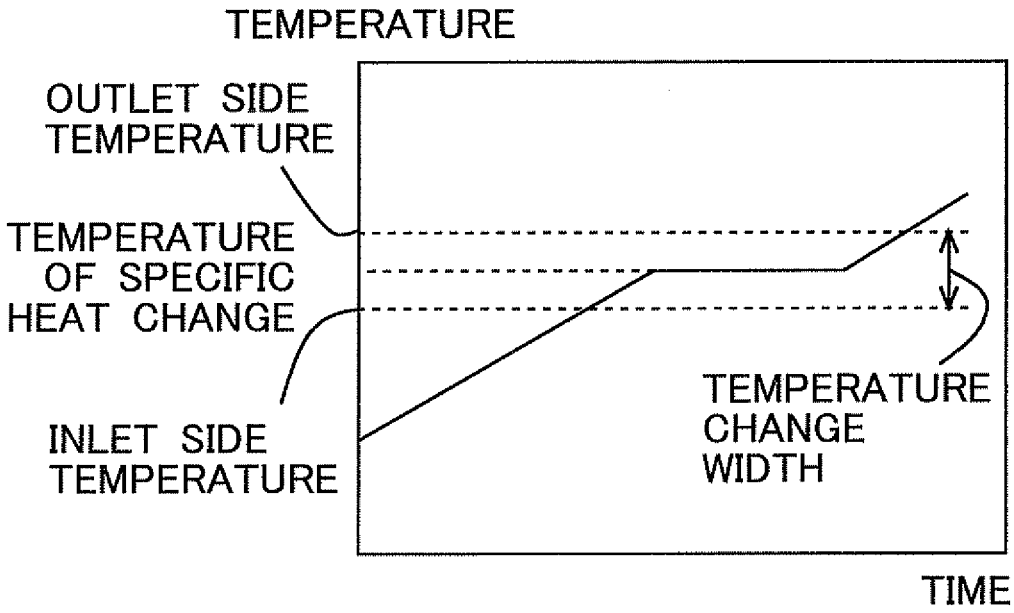
FIG. 5 shows a relationship among a temperature of the cooling water allowed to flow into the internal combustion engine, another temperature of the cooling water allowed to flow into the internal combustion engine, and the temperature of specific heat change.

In this context, FIG. 5 shows a relationship among the temperature (inlet side temperature) of the cooling water allowed to flow into the internal combustion engine 1, the temperature (outlet side temperature) of the cooling water allowed to flow into the internal combustion engine 1, and the temperature of specific heat change D. In this context, in this embodiment, the valve opening temperature of the thermostat 15 is set so that the following relationship holds.

inlet side temperature<temperature of specific heat change D<outlet side temperature That is, the temperature of specific heat change D is higher than the inlet side temperature, and the outlet side temperature is higher than the temperature of specific heat change D. Therefore, the temperature of specific heat change D is provided when the cooling water is allowed to flow through the water jacket 2. Accordingly, the specific heat is raised at the inside of the internal combustion engine 1. Therefore, it is possible to suppress the increase in the temperature of the cooling water at the inside of the internal combustion engine 1. Accordingly, it is possible to stabilize the operation state of the internal combustion engine 1.

In the meantime, the larger the degree of deterioration of the cooling water is, the larger the temperature change width as the difference between the outlet side temperature and the inlet side temperature is. Similarly, the difference between the temperature of the cooling water allowed to inflow into the radiator 13 and the temperature of the cooling water allowed to outflow from the radiator 13 is also increased in accordance with the deterioration of the cooling water. That is, when the degree of deterioration of the cooling water is increased, then the amount of heat, which can be absorbed by the change of the specific heat, is decreased, and hence the temperature change width is increased. Therefore, it is possible to judge the deterioration of the cooling water on the basis of the temperature change width.

If the valve opening temperature T2 of the thermostat 15 is not set properly, the temperature change width is increased as well. Therefore, it is also necessary to judge by what cause the temperature change width is increased.

Figure 6:
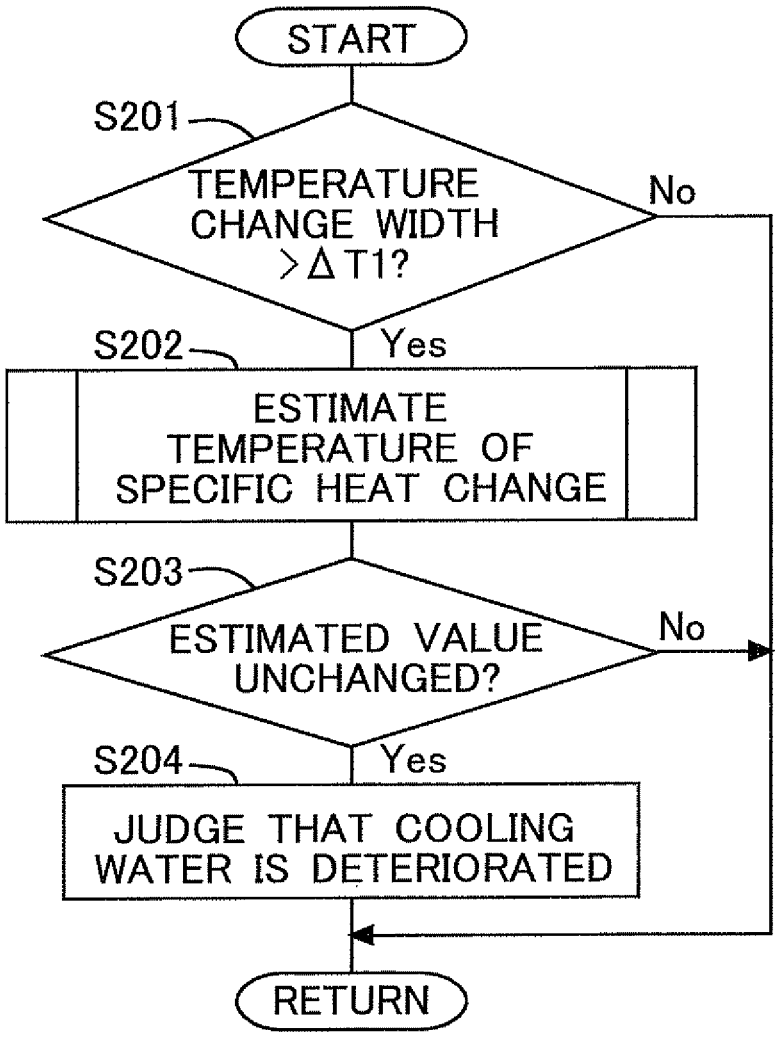
FIG. 6 shows a flow chart illustrating a flow of the deterioration judgment for the cooling water according to a second embodiment.

FIG. 6 shows a flow chart illustrating a flow of the deterioration judgment for the cooling water according to this embodiment. This routine is executed at every predetermined period of time when the thermostat 15 is controlled by ECU 30 in accordance with the valve opening temperature T2 of the thermostat 15 set in the first embodiment.

In Step S201, it is judged whether or not the temperature change width is larger than a predetermined value ΔT1. The predetermined value ΔT1 is the upper limit value of the range in which the cooling water is regarded to be not deteriorated. If the affirmative judgment is made in Step S201, the routine proceeds to Step S202. If the negative judgment is made, then it is estimated that the cooling water is not deteriorated, and hence this routine is completed.

In Step S202, the temperature of specific heat change is estimated. That is, the temperature of specific heat change is estimated as explained in the first embodiment. The temperature of specific heat change, which has been stored in ECU 30, is changed in some cases, for example, on account of the battery exchange. The temperature change width is also increased in such a situation. Therefore, it is necessary to judge whether the setting of the temperature of specific heat change is erroneous or the cooling water is deteriorated. Therefore, the temperature of specific heat change is estimated again.

In Step S203, it is judged whether or not the value estimated in Step S202 is unchanged from the value estimated last time. That is, in Step S203, it is judged whether or not the estimated value of the temperature of specific heat change is correct. If the affirmative judgment is made in Step S203, then the routine proceeds to Step S204, and it is judged that the cooling water is deteriorated. On the other hand, if the negative judgment is made in Step S203, this routine is completed. Further, if the negative judgment is made, then it is feared that the valve opening temperature T2 of the thermostat 15 is not set properly, and hence the valve opening temperature T2 is set again.

If it is judged that the cooling water is deteriorated, it is also allowable that the valve opening temperature of the thermostat 15 is set to be low as compared with the case in which the cooling water having the specific heat that does not change is used. That is, in the case of the cooling water having the changeable specific heat, the specific heats before the change and after the change are lower than the specific heat of the cooling water having the specific heat that does not change. Accordingly, it is possible to facilitate the warming-up of the internal combustion engine 1. Therefore, when the cooling water having the changeable specific heat is deteriorated, the overheat tends to occur more easily as compared with the case in which the cooling water having the specific heat that does not change is used. In relation thereto, it is possible to suppress the overheat of the internal combustion engine 1 by lowering the valve opening temperature of the thermostat 15.

As explained above, according to this embodiment, it is possible to estimate the deterioration of the cooling water with ease. Further, the valve opening temperature of the thermostat 15 can be set depending on the deterioration of the cooling water.

The invention claimed is:

1. A cooling system for an internal combustion engine comprising:

a radiator which is provided for a cooling water passage of the internal combustion engine and which deprives heat from cooling water;

a bypass passage which bypasses the radiator;

an electronically-controlled thermostat which shuts off flow of the cooling water to the radiator so that the cooling water is allowed to flow to the bypass passage in a valve closed state and which allows the cooling water to flow through at least the radiator in a valve open state;

a sensor which detects a temperature of the cooling water; and a control unit which has program logic to open and close the thermostat based on the detected value of the sensor and program logic to change a valve opening temperature of the thermostat, the control unit including program logic to (a) forbid valve opening of the thermostat and (b) estimate, based on transition of the temperature of the cooling water detected by the sensor, whether (i) a first cooling water is used, the first cooling water containing a substance that undergoes structural phase transition at a predetermined temperature, thereby absorbing or releasing heat with temperature change so as to have changeable specific heat, or (ii) a second cooling water is used, the second cooling water being without a substance that undergoes structural phase transition at a predetermined temperature to absorb or release heat with temperature change, wherein, when the valve opening is forbidden, if the temperature of the cooling water becomes constant, the control unit estimates that (i) the first cooling water is used and (ii) the temperature at which the temperature of the first cooling water is constant is the temperature of change of the specific heat of the first cooling water, and wherein, when the valve opening is forbidden, if the temperature of the cooling water does not become constant, the control unit estimates that the second cooling water is used.

2. The cooling system for the internal combustion engine according to claim 1, wherein the control unit comprises program logic to estimate a temperature at which the specific heat is changed when the cooling water having the changeable specific heat is used.

3. The cooling system for the internal combustion engine according to claim 2, wherein the control unit comprises program logic to set the valve opening temperature of the thermostat, when the cooling water having the changeable specific heat is used, to be higher than the temperature at which the specific heat is to be changed as estimated by the control unit.

4. The cooling system for the internal combustion engine according to claim 2, wherein the control unit comprises program logic to estimate whether or not the cooling water is deteriorated on the basis of a difference between (i) a temperature of the cooling water at a first position at which the temperature is higher than the temperature of change of the specific heat, and (ii) a temperature of the cooling water at a second position at which the temperature is lower than the temperature of change of the specific heat.

5. The cooling system for the internal combustion engine according to claim 4, wherein the control unit comprises program logic to estimate that the cooling water is deteriorated, if the difference between (i) the temperature of the cooling water at the first position at which the temperature is higher than the temperature of change of the specific heat, and (ii) the temperature of the cooling water at the second position at which the temperature is lower than the temperature of change of the specific heat is larger than a threshold value.

6. The cooling system for the internal combustion engine according to claim 1, wherein the control unit comprises program logic to periodically estimate a character of the cooling water.

* * * * *